US010947623B2

(12) United States Patent
Maekawa et al.

(10) Patent No.: US 10,947,623 B2
(45) Date of Patent: Mar. 16, 2021

(54) ELECTROLESS PLATING BATH

(71) Applicant: C. Uyemura & Co., Ltd., Osaka (JP)

(72) Inventors: Takuma Maekawa, Osaka (JP); Toshiaki Shibata, Osaka (JP); Yukinori Oda, Osaka (JP)

(73) Assignee: C. UYEMURA & CO., LTD., Osaka (JP)

( * ) Notice: Subject to any disclaimer, the term of this patent is extended or adjusted under 35 U.S.C. 154(b) by 0 days.

(21) Appl. No.: 16/689,267

(22) Filed: Nov. 20, 2019

(65) Prior Publication Data

US 2020/0173030 A1 Jun. 4, 2020

(30) Foreign Application Priority Data

Nov. 30, 2018 (JP) ..... JP2018-224984

(51) Int. Cl.
*C23C 18/44* (2006.01)
*C23C 18/16* (2006.01)

(52) U.S. Cl.
CPC ..... *C23C 18/44* (2013.01); *C23C 18/1683* (2013.01)

(58) Field of Classification Search
None
See application file for complete search history.

(56) References Cited

U.S. PATENT DOCUMENTS 6,676,919 B1 1/2004 Fischer et al.
7,678,183 B2 * 3/2010 Murasumi ..... C23C 18/1651 106/1.24
2003/0108664 A1 * 6/2003 Kodas ..... H01B 1/026 427/125
2007/0154360 A1 7/2007 Daly et al.
2008/0214884 A1 9/2008 Daly et al.
(Continued)

FOREIGN PATENT DOCUMENTS

CN 1354690 6/2002
CN 108823554 11/2018
(Continued)

OTHER PUBLICATIONS

English translation of CN 108823554, Nov. 2018; 9 pages.*
(Continued)

*Primary Examiner* — Helene Klemanski
(74) *Attorney, Agent, or Firm* — Wenderoth, Lind & Ponack, L.L.P.

(57) ABSTRACT

An object of the present invention is to provide an electroless plating bath having excellent property in plating film deposition without containing halides such as chloride in the electroless plating bath. A halogen-free electroless plating bath of the present invention comprising:
a water soluble platinum compound or
a water soluble palladium compound, and
a reducing agent wherein
the water soluble platinum compound is a tetraammine platinum (II) complex salt excluding a halide of the tetraammine platinum (II) complex salt,
the water soluble palladium compound is a tetraammine palladium (II) complex salt excluding a halide of the tetraammine palladium (II) complex salt and tetraammine palladium (II) sulfate,
the reducing agent is formic acid or its salts, and
the electroless plating bath contains no halide as an additive.

2 Claims, 1 Drawing Sheet

(56) References Cited

U.S. PATENT DOCUMENTS

| | | | | |
|---|---|---|---|---|
| 2008/0277140 | A1* | 11/2008 | Kurosaka | H05K 3/244 174/126.1 |
| 2012/0234584 | A1 | 9/2012 | Ejiri et al. | |
| 2014/0217328 | A1 | 8/2014 | Daly et al. | |
| 2017/0042040 | A1 | 2/2017 | Bengston | |
| 2017/0145567 | A1 | 5/2017 | Bengston | |
| 2018/0305819 | A1 | 10/2018 | Kato et al. | |
| 2019/0309423 | A1* | 10/2019 | Sasamura | C23C 18/44 |
| 2019/0345612 | A1* | 11/2019 | Tanabe | C23C 18/54 |
| 2020/0020660 | A1* | 1/2020 | Maekawa | H01L 23/49811 |
| 2020/0248312 | A1* | 8/2020 | Maeda | C23C 18/44 |

FOREIGN PATENT DOCUMENTS

| | | | |
|---|---|---|---|
| DE | 10 2004 046 258 | | 4/2006 |
| EP | 3 470 546 | | 4/2019 |
| EP | 3 480 339 | | 5/2019 |
| JP | 2009-511748 | | 3/2009 |
| JP | 2018-3108 | | 1/2018 |
| JP | 6352879 | | 7/2018 |
| JP | 2018/522142 | | 8/2018 |
| WO | 2017/217125 | | 12/2017 |
| WO | WO 2018/008242 | A1 * | 1/2018 |
| WO | WO 2019/069964 | A1 * | 4/2019 |

OTHER PUBLICATIONS

English translation of DE 102004046258, Apr. 2006; 8 pages.*
Office Action dated Jan. 3, 2020 in corresponding Taiwanese Patent Application No. 108143565, with English Translation.
Notice of Reasons for Refusal dated Jan. 8, 2019 in corresponding Japanese Application No. 2018-224984, with English translation.
Notice of Reasons for Refusal dated Mar. 26, 2019 in corresponding Japanese Application No. 2018-224984, with English translation.
Decision of Refusal dated Jun. 11, 2019 in corresponding Japanese Application No. 2018-224984, with English translation.
Decision to grant a patent dated Aug. 6, 2019 in corresponding Japanese Application No. 2018-224984, with English translation.
Office Action dated Jun. 29, 2020 in corresponding German Patent Application No. 10 2019 008 239.7 with English-language translation.
Office Action dated Sep. 4, 2020 in corresponding Chinese Patent Application No. 201911199413.6, with English translation.

* cited by examiner

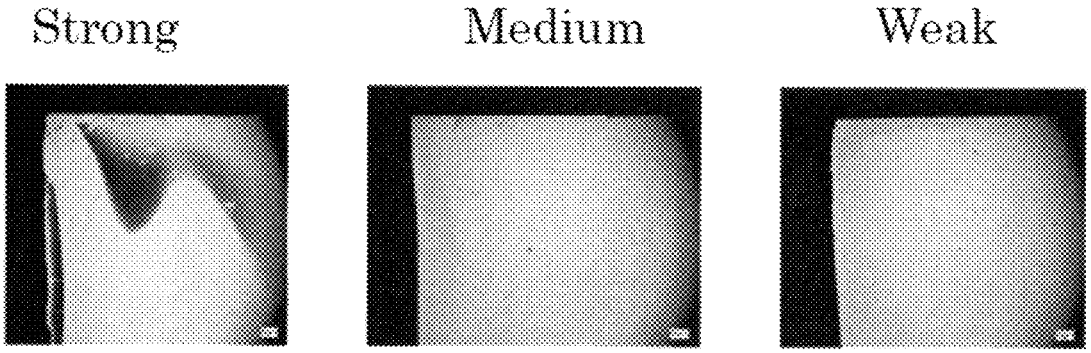
Strong
Medium
Weak

ELECTROLESS PLATING BATH

CROSS-REFERENCE TO RELATED APPLICATIONS

This application is related to and claims priority under 35 U.S.C. 119 to Japanese Patent Application No. 2018-224984, filed on Nov. 30, 2018, incorporated herein by reference in its entirety.

TECHNICAL FIELD

The present invention relates to an electroless plating bath and more precisely a halogen-free electroless plating bath.

BACKGROUND ART

Plating films are widely used for various electronic parts such as semiconductor circuits and joining terminals. In recent year, platinum (herein after may be called as "Pt") plating films and palladium (herein after may be called as "Pd") plating films are widely noticed as substitutes for underlying metal plating for Au plating films. Because Pt plating films and Pd plating films are excellent in diffusion preventability for preventing diffusion of conductive underlying layers (e.g. Ni) into a surface of Au layer by thermal history, excellent in chemical stability and excellent in electrical conductivity. Electroless Pt plating baths and electroless Pd plating baths (herein after may be called as "electroless plating bath" unless otherwise specified each bath) for forming these plating films are required to be efficiently deposited on the object to be plated to form a plating film, namely, required to have excellent plating film deposition.

Meanwhile, electroless Pt plating baths and electroless Pd plating baths are required to have excellent electroless plating bath stability for suppressing deposition of Pt or Pd in the electroless plating bath for a long period because the electroless plating baths are easily decomposed by self-decomposition. Therefore, primary importance is devoted to the plating film deposition and the electroless plating bath stability of electroless plating baths in industrial scale production. To ensure the electroless plating bath stability, electroless plating baths necessarily contained additives such as chloride contributing to electroless plating bath stability. For examples, JP6352879B discloses that an electroless plating bath containing chlorides derived from platinum compounds such as chloroplatinic (II) acid and chloroplatinic (IV) acid. And JP-A-2013-3108 discloses that an electroless Pt plating bath containing a halide ion supplying agent such as sodium chloride to improve electroless plating bath stability and plating film deposition.

However, halides such as chloride, bromide, fluoride, and iodide contained in electroless plating baths are known as a cause for corrosion of a substrate or underlying metals during plating treatment. For improving reliability in electronic parts, an electroless plating bath containing substantially no halogen, namely, a halogen-free electroless plating bath has been expected.

SUMMARY OF THE INVENTION

Technical Problem

The present invention has been made in view of the above issues, and an object of the present invention is to provide an electroless plating bath having excellent property in plating film deposition without containing halides such as chloride in the electroless plating bath.

Solution to the Problem

A halogen-free electroless plating bath of the present invention solving above problems is:

[1] a halogen-free electroless plating bath comprising
a water soluble platinum compound or
a water soluble palladium compound, and
a reducing agent wherein the water soluble platinum compound is a tetraammine platinum (II) complex salt excluding a halide of the tetraammine platinum (II) complex salt, the water soluble palladium compound is a tetraammine palladium (II) complex salt excluding a halide of the tetraammine Pd(II) complex salt and tetraammine palladium (II) sulfate, the reducing agent is formic acid or its salts, and the electroless plating bath contains no halide as an additive.

[2] As a preferable halogen-free electroless plating bath of above [1], the tetraammine platinum (II) complex salt is tetraammine platinum (II) hydroxide or tetraammine platinum (II) nitrate.

[3] As a preferable halogen-free electroless plating bath of above [1], the tetraammine palladium (II) complex salt is tetraammine palladium (II) hydroxide or tetraammine palladium (II) nitrate.

As a preferable halogen-free electroless plating bath of at least one selected from above [1] to [3], the electroless plating film does not contain a halide derived from additives.

Advantageous Effects of the Invention

The present invention provides an electroless plating bath excellent in plating film deposition without containing halides.

BRIEF DESCRIPTION OF THE DRAWINGS

The FIGURE illustrates drawing substitute photographs each showing a surface state of a substrate as a criteria for evaluation of corrosion test.

DESCRIPTION OF EMBODIMENTS

The present inventors had intensively studied to provide a halogen-free electroless plating bath. Conventional electroless Pt plating baths contained a platinum complex combining bivalent or tetravalent platinum ions with various kinds of ligands. Platinum complexes without a halogen, namely, halogen-free platinum complexes were prepared by combining bivalent platinum (herein after may be called as "Pt (II)") or tetravalent platinum (herein after may be called as "Pt (IV)") with various kinds of ligands for evaluating the properties of halogen-free plating baths by the present inventors. Results showed that, as a water soluble platinum compound, only tetraammine Pt (II) complex salts with ammonia ($NH_3$) or hexaammine Pt (IV) complex salts with ammonia ($NH_3$) as a ligand in a halogen-free plating bath exhibited sufficient electroless plating bath stability. And these water soluble platinum compounds were considered to be effective for providing a halogen-free electroless plating bath. The present inverters examined plating film deposition of the electroless plating baths. Results showed that only tetraammine Pt (II) complex salts exhibited excellent plating film deposition. Specifically, as shown in Examples No. 1 to 5 in Table 2, the electroless plating bath containing a Pt (II) complex salt achieved to deposit a Pt plating film on a micropad which was unachievable by conventional electroless plating baths. Meanwhile, hexaammine Pt (IV) complex salts resulted in insufficient plating film deposition. Specifically, as shown in Comparative Example No, 6 in Table 3, the electroless plating bath containing Pt (IV) complex salts showed difficulty in forming, a Pt plating film on a micropad. Detailed studies on plating film deposition of the electroless plating baths revealed that Pt (IV) complex salts achieved higher stability than. Pt (II) complex salts because Pt (TV) complex salts have low deposition potential. However, high stability of Pt (IV) complex salts in a halogen-free electroless plating bath hinders deposition and resulted in poor plating film deposition. Consequently, the present invention employs one or more kinds of tetraammine Pt (II) complex salts as a supply source of a water soluble platinum compound for a halogen-free electroless Pt plating bath.

Palladium for Pd electroless plating baths exhibited a similar tendency. That is, only tetraammine Pd (II) complex salts exhibited excellent plating deposition and electroless plating bath stability. Consequently, the present invention employs one or more kinds of tetraammine Pd (II) complex salts as a supply source of a water soluble palladium compound for a halogen-free electroless Pd plating bath.

In the present invention, "electroless plating bath" includes both an electroless Pt plating bath and an electroless Pd plating bath. And following explanation is applied to below electroless plating baths (1) and (2) unless otherwise specified each bath. The electroless plating bath adopts following composition in accordance with a kind of contained metal.

(1) A halogen-free electroless Pt plating bath containing a water soluble Pt compound and a reducing agent wherein the water soluble Pt compound is a tetraammine Pt (II) complex salt (excluding a halide of a tetraammine Pt (II) complex salt).

(2) A halogen-free electroless Pd plating bath containing a water soluble Pd compound and a reducing agent wherein the water soluble Pd compound is a tetraammine Pd (II) complex salt (excluding a halide of the tetraammine Pd (II) complex salt and tetraammine palladium (II) sulfate).

Herein after, a halogen-free electroless plating bath of the invention is explained.

[1] Water Soluble Pt Compound

A water soluble Pt compound contained in the electroless Pt plating bath of the present invention is a tetraammine Pt (II) complex salt (excluding a halide of a tetraammine Pt (II) complex salt) (herein after, a phrase "excluding a halide of a tetraammine Pt (II) complex salt" is omitted from the expression of the tetraammine Pt (II) complex salt). As mentioned above, the tetraammine Pt (II) complex salt in the halogen-free electroless Pt plating bath exhibits excellent electroless plating bath stability because the tetraammine Pt (II) complex salt remains without self-decomposition for a long period and thereby deposition of Pt is suppressed.

The present invention does not use a water soluble Pt compound containing a halide such as dichlorotetraammine Pt (II) as a tetraammine Pt (II) complex salt to provide the halogen-free electroless Pt plating bath. Therefore, the tetraammine Pt (II) complex salt without a halide is used in the present invention. Examples of the tetraammine Pt (II) complex salt of the present invention include tetraammine Pt (II) hydroxide, tetraammine Pt (II) nitrate, tetraammine Pt (II) citrate, tetraammine Pt (II) bicarbonate, tetraammine Pt (II) acetate, tetraammine Pt (II) oxalate, tetraammine Pt (II) maleate and their hydrates. Tetraammine Pt (II) hydroxide and tetraammine Pt (II) nitrate are preferable among above examples. These tetraammine Pt (II) complex salts can be used alone or in combination of two or more of them.

An addition amount of the tetraammine Pt (II) complex salt as a concentration of Pt in the electroless Pt plating bath is preferably 0.1 g/L or more, more preferably 0.3 g/L or more, even more preferably 0.5 g/L or more. Increasing the concentration of Pt in the electroless Pt plating bath enhances a deposition rate of the plating film resulted in increasing productivity. Meanwhile, controlling the concentration of Pt enables to suppress lowering of physical properties of the plating film caused by abnormal precipitation. The concentration of Pt in the electroless Pt plating bath is preferably 3.0 g/L or less, more preferably 2.0 g/L or less, even more preferably 1.0 g/L or less. The concentration of Pt is measured by atomic absorption spectroscopy (AAS) with an atomic absorption photometry.

[2] Water Soluble Pd Compound

A water soluble Pd compound contained in the electroless Pd bath of the present invention is a tetraammine Pd (II) complex salt (excluding a halide of a tetraammine Pd (II) complex salt and tetraammine palladium (II) sulfate) (herein after, a phrase of "excluding a halide of a tetraammine Pd (II) complex salt and tetraammine palladium (II) sulfate" is omitted from the expression of the tetraammine Pd (II) complex salt). As mentioned above, the tetraammine Pd (II) complex salt in the halogen-free electroless Pd plating bath exhibits excellent electroless plating bath stability because the tetraammine Pd (II) complex salt remains in the bath without self-decomposition for a long period and thereby deposition of Pd in the bath is suppressed.

The present invention does not use a water soluble Pd compound containing a halide such as dichlorotetraammine Pd (II) as a tetraammine Pd (II) complex salt to provide the halogen-free electroless Pd plating bath. Therefore, the tetraammine Pd (II) complex salt without a halide is used in the present invention. Examples of the tetraammine Pd (II) complex salt of the present invention include tetraammine Pd (II) hydroxide, tetraammine Pd (II) nitrate, tetraammine Pd (II) acetate, tetraammine Pd bicarbonate, tetraammine Pd (II) sulfate, tetraammine Pd (II) oxalate and their hydrates. Tetraammine Pd (II) hydroxide, tetraammine Pd nitrate and tetraammine Pd (II) sulfate are preferable among above examples. These tetraammine Pd (II) complex salts can be used alone or in combination of two or more of them.

An addition amount of the tetraammine Pd (II) complex salt as a concentration of Pd in the electroless Pd plating bath is preferably 0.01 g/L or more, more preferably 0.1 g/L or more, even more preferably 0.5 g/L or more. Increasing the concentration of Pd in the electroless Pd plating bath enhances a deposition rate of the plating film resulted in increasing productivity. Controlling the concentration of Pd ions enable to suppress lowering of physical properties of the plating film caused by abnormal precipitation. The concentration of Pd in the electroless Pd plating bath is preferably 3.0 g/L or less, more preferably 2.0 g/L or less, even more preferably 1.0 g/L or less. The concentration of Pd is measured by the same method as the concentration of Pt.

[3] Reducing Agent

A reducing agent contained in the electroless plating bath is a kind of additive having a reducing action and a precipitation action of a Pt ion or a Pd ion. Examples of the reducing agent include formic acid and its salts. As examples of the formic acid salt includes alkali metal salts such as potassium, sodium; alkaline earth metal salts such as magnesium, calcium; ammonium salt, quaternary ammonium salt, amine salts such as including primary amine, secondary amine, and tertiary amine. These examples of the reducing agent can be used alone or in combination of two or more of them. Formic acid or its salts (herein after may be called as "formic acids") is a preferable reducing agent in the halogen-free electroless plating bath for exhibiting excellent reducing action and precipitation action. Specifically, the electroless plating bath containing a tetraammine Pt (II) complex salt or a tetraammine Pd (II) complex salt: and formic acids exhibits more excellent effects in corrosion suppression of an underlying metal and a substrate, plating film deposition and electroless plating bath stability.

Examples of the formic acid salts include alkali metal formates such as potassium formate, sodium formate; alkaline earth metal formates such as magnesium formate, calcium formate; ammonium formates, quaternary ammonium formate, formic acid amine salt including primary amine, secondary amine, and/or tertiary amine. These formic acids can be used alone or in combination of two or more of them.

The concentration of the formic acids in the electroless plating bath is preferably 1 g/L, or more, more preferably 5 g/L or more, even more preferably 10 g/L or more, still more preferably 20 g/L or more to exhibit remarkable effects above. Also, in view of electroless plating bath stability, the concentration of the formic acids in the electroless plating bath is preferably 100 g/L or less, more preferably 80 g/L or less, even more preferably 50 g/L or less.

The electroless plating bath of the present invention can consist of the tetraammine Pt (II) complex salt or the tetraammine Pd (II) complex salt and the reducing agent. Also, the electroless plating bath of the present invention can include various additives if necessary. Examples of the additive include various known additives used as a buffer agent, a pH regulator, a complexing agent, a stabilizing agent, and a surface active agent. The present invention prefers additives without containing a halide. The present invention achieves to exhibit electroless plating bath stability without containing a halide in the electroless plating baths. Accordingly, the present invention prefers a electroless plating bath without a halide derived from a water soluble Pt compound, a water soluble Pd compound and additives.

As the electroless plating bath, the present invention prefers the electroless plating bath free from a halide except for a halide intruded as inevitable impurities. No use of additives containing a halogen achieves the halogen-free electroless plating bath. The electroless plating bath of the present invention allows a halogen to be included as inevitable impurities derived from a raw material or a production process. The concentration of Cl in the electroless plating bath, for example, preferably 20 ppm or less, more preferably 10 ppm or less, even more preferably 5 ppm or less and the most preferably 0 ppm or unmeasurable low level. The concentration of Cl is measured by inductively coupled plasma emission spectrometric analyzer (as for example, HORIBA, Ltd., Ultima Expert: standard addition method: output: 1200W: wavelength: 134.724 nm).

The additives preferably used in the electroless plating bath of the present invention are explained below.

[4] Buffer Agent

A buffer agent is an additive to act for controlling pH of the electroless plating bath. A pH of the electroless Pt plating bath of the present invention is preferably 7 or more, more preferably 9 or more and preferably 10 or less. Also, a pH of the electroless Pd plating bath of the present invention is preferably 5 or more, more preferably 6 or more and preferably 8 or less, more preferably 7 or less. Preferably, controlling the pH of the electroless plating bath within the above range enables to maintain electroless plating bath stability and to improve a deposition rate during plating treatment.

Various known acids or alkalies can be used as a pH regulator for controlling the pH of the electroless plating bath. Also, a buffer agent having buffer action can be added to the electroless plating bath. Examples of the pH regulator include acids such as sulfuric acid, nitric acid, phosphoric acid, and carboxylic acid; alkalies such as sodium hydroxide, potassium hydroxide, and ammonia water. Also, examples of the pH buffer include carboxylic acids such as citric acid, i.e. trisodium citrate dihydrate, tartaric acid, malic acid, and phthalic acid; phosphoric acid such as orthophosphoric acid, phosphorous acid, hypophosphorous acid, pyrophosphoric acid; and its phosphate such as a potassium salt, a sodium salt (for example, trisodium phosphate 12-water), and ammonium salt; boric acid, and tetraboric acid. These examples can be used alone or in combination of two or more of them. A concentration of the buffer agent is not specifically limited and controls to adjust the pH in the above range by adding the buffer agent.

[5] Complexing Agent

A complexing agent is an additive to act as for suppressing a reducing action and a precipitation action of metal composition in the electroless plating bath. Preferably, adding the complexing agent to the electroless Pd plating bath yields the stabilization of Pd solubility. The complexing agent is not particularly limited but may be various known complexing agents such as ammonia, amine compounds, and carboxylic acids. Examples of the amine compound include methylamine, dimethylamine, trimethylamine, benzyl amine, methylenediamine, ethylenediamine, ethylenediamine derivatives, tetramethylenediamine, diethylenetriamine, ethylenedinitrilo tetraacetic acid, ethylenediamine sulfate or its alkali metal salt, EDTA derivative, and glycine. Examples of carboxylic acids include acetic acid, propionic acid, citric acid, malonic acid, malic acid, oxalic acid, succinic acid, tartaric acid, lactic acid, butyric acid and their salts. The salts indicate above exemplified alkali metal salts such as potassium salt or sodium salt; alkali earth metal salts, or ammonium salts. Among examples at least one selected from ammonia and amine compounds are preferable and amine compounds is more preferably selected. The complexing agent may be used alone or in combination of two or more kinds of them.

A content of the complexing agent in the electroless plating bath can properly be adjusted to obtain above effects of the complexing agent. The content of the complexing agent is a content of a singly used complexing agent or a total content of two or more of complexing agents. The content of the complexing agent in the electroless plating bath is preferably 0.5 g/L or more, more preferably 1 g/L or more, even more preferably 3 g/L or more, still more preferably 5 g/L or more and preferably 50 g/L or less, more preferably 30 g/L or less, even more preferably 20 g/L or less, still more preferably 10 g/L or less.

[6] Stabilizing Agent

A stabilizing agent is added as necessary for improving electroless plating bath stability, surface appearance and for controlling a plating film deposition speed. The stabilizing agent is not limited to specific types but may be selected from various known stabilizing agents,

[7] Surface Active Agent

A surface active agent is added as necessary for improving electroless plating bath stability, for improving surface appearance and for preventing occurrence of a pit. The surface active agent of the present invention is not particularly limited but may be selected from various known surfactants such as nonionic surfactant, cationic surfactant, anionic surfactant, and amphoteric surfactant.

The present inventive electroless plating bath satisfying above composition suppresses corrosion of an underlying metal wiring such as Ni and Cu, corrosion of the substrate such as silicon substrate and Al alloy substrate during plating treatment caused by a halogen and specifically chloride. Therefore, a plating film produced from the electroless plating bath of the invention provides excellent electrical characteristics such as low resistivity and low contact resistance and connection reliability such as a junction reliability of wirings.

In addition, the electroless plating bath of the present invention provides a plating film with desired film thickness on a micropad on which a film is to be deposited. The electroless plating bath of the present invention provides excellent plating film deposition on a micropad having its pad area size of, for examples, preferably 200 μm×200 μm or less, more preferably 100 μm×100 μm or less, even more preferably 60 μm×60 μm or less.

The plating film prepared by the electroless plating bath of the present invention is suitable for halogen-free electronic parts. Examples of the component of electronic equipment includes chip parts, crystal oscillators, bumps, connectors, lead frames, hoops, semiconductor packages, and printed circuit boards.

A substrate material for depositing a plating film by the electroless plating bath of the invention is not specifically limited and examples include various known substrates such as an Al substrate, an Al alloy substrate, a Cu substrate, a Cu alloy substrate, and a silicon substrate; a plating film (an underlying metal) deposited on a substrate by a metal having catalytic property for reduction and deposition properties for a plating film such as Fe, Co, Ni, Cu, Zn, Ag, Au and their alloys. Also, a metal without catalytic property can be used as an object to be plated by employing various methods.

The present invention can employ various known methods appropriately for conducting electroless Pt plating by using the electroless Pt plating bath of the present invention without restricting its plating conditions and plating apparatuses. Examples of a temperature of the electroless plating bath during plating treatment are preferably 40° C. or higher, more preferably 50° C. or higher, even more preferably 60° C. or higher and still more preferably 70° C. or higher, and preferably 90° C. or lower, more preferably 80° C. or lower. Also, a plating treatment time can be suitably adjusted to form a plating film with desired film thickness and the plating treatment time is preferably 1 minute or more, more preferably 5 minutes or more, and preferably 60 minutes or less and more preferably 10 minutes or less. A film thickness of Pt plating film can be selected suitably to obtain desired properties and the film thickness is usually 0.001 to 0.5 μm.

The present invention can employ various known methods appropriately for conducting electroless Pd plating by using the electroless Pd plating bath of the present invention without restricting its plating conditions and plating apparatus. Examples of a temperature of the electroless plating bath during plating treatment are preferably 40° C. or higher, and more preferably 50° C. or higher, even more preferably 60° C. or higher and preferably 90° C. or lower, more preferably 80° C. or lower and even more preferably 70° C. or lower. Also, plating treatment time can be suitably adjusted to form a plating film with desired film thickness and the plating treatment time is preferably 1 minute or more, more preferably 5 minutes or more, and preferably 60 minutes or less and more preferably 10 minutes or less. A film thickness of the Pd plating film can be selected suitably to obtain desired properties and the film thickness is usually 0.001 to 0.5 μm.

EXAMPLES

The present invention will be more specifically described below, by way of examples. However, the present invention is not limited by the following examples. It is naturally understood that modifications may be properly made and practiced within the scope adaptable to the gists described above and below. All of these are included in the technical scope of the present invention.

Experiment 1: Electroless Pd Plating Bath

A laminate of metal conductive layers was deposited on one surface of a substrate by electroless plating treatment. Steps of the plating pretreatment shown in Table 1 was conducted to the substrate before depositing an electroless plating film. That is, the plating pretreatment shown in following steps 1 to 5 were applied to the substrate in sequent.

Step 1: degreasing-washing treatment was conducted to the substrate (Si TEG wafer) by using MCL-16 (EPITHAS (register trade mark) MCL-16 manufactured by C. Uyemura & Co., Ltd.).

Step 2: acid pickling treatment was conducted to the substrate by using 30 mass % of a nitric acid solution to form an oxide film on the surface of the substrate.

Step 3: primary zincate treatment was conducted to the substrate by using MCT-51 (EPITHAS (register trade mark) MCT-51 manufactured by C. Uyemura & Co, Ltd.).

Step 4: acid pickling treatment was conducted to the substrate for peeling the Zn replacing layer to form an oxide film on the surface of the substrate.

Step 5: secondary zincate treatment was conducted to the substrate by using MCT-51 (EPITHAS (register trade mark) MCT-51 manufactured by C. Uyemura & Co., Ltd.).

After conducting the plating pretreatment to the substrate, plating films as an underlying layer was deposited on the surface of the substrate by conducting following steps 6 and 7 in sequent under the condition shown in Table 1 to the substrate.

Step 6: a Ni plating film (a first layer) as a conductive underlying layer was deposited on the surface of the substrate by electroless plating treatment using a Ni plating bath (NIMUDEN (register trade mark) manufactured by C. Uyemura & Co., Ltd.).

Step 7: a Pd plating film (a second layer) was deposited on the surface of the Ni plating film by electroless plating treatment using a Pd plating bath (EPITHAS (register trade mark) TFP-23 manufactured by C. Uyemura & Co., Ltd.).

Step 8: After depositing the underlying layers on the surface of the substrate, a Pt plating film was deposited by electroless plating treatment using a Pt plating bath shown in Tables 2 and 3.

Following tests were conducted to the obtained test piece.

[Film Thickness Measurement]

The film thickness of the Pt plating film deposed on each pad having its area of 60 μm×60 μm, 100 μm×100 μm and 200 μm×200 μm was measured by fluorescent X-ray spectrometric method for measuring thickness with XDV-μ (manufactured by Fischer Instruments K.K.). "undeposition" in the Tables indicates a test piece unable to identify plating film deposition or a test piece having plating film defects such as a gap. And "-" in the Tables indicates a plating bath with inferior to electroless plating bath stability resulted in unable to use.

[Electroless Plating Bath Stability]

Deposition of Pt particles was examined by visually observing a electroless Pt plating bath after the electroless plating treatment and evaluated based on the following criteria.

Good: no deposition of Pt particles was observed for more than a week after the electroless plating treatment.

Poor: deposition of Pt particles was confirmed from more than 24 hour to within a week after the electroless plating treatment.

Failure: deposition of Pt particles was confirmed within 24 hour after the electroless plating deposition.

[Substrate Corrosion]

Corrosion of the substrate was evaluated by the following criteria by observing a non-deposition surface of the substrate, which was the other surface of the substrate having the plating film, with a Digital Microscope (VHX-5000 manufactured by KEYENCE CORPORATION). The present invention evaluates "Weak" and "Medium-Weak" as good condition. Each criteria of the surface state of the substrate is shown in the FIGURE.

Strong: corrosion on the surface of the substrate was confirmed by a pit formed by erosion of the surface of the substrate.

Medium: mild corrosion on the surface of the substrate was confirmed by that more than 50% of the surface area of the substrate was roughened largely.

Weak: little corrosion on the surface of the substrate was confirmed by that more than 50% of the surface area of the substrate was maintained within acceptable level of surface roughness.

Notice, "Medium-Weak" evaluation was applied to a substrate having "Medium" evaluation to a part of the substrate (less than 50% of surface area of the substrate).

TABLE 1

| | plating pre treatment | process liquid | processing temperature | processing time (sec.) |
|---|---|---|---|---|
| 1 | degreasing | MCL-16 | 50° C. | 300 |
| 2 | acid pickling | 30 mass % nitric acid | normal temperature | 60 |
| 3 | primary zincate treatment | MCT-51 | normal temperature | 30 |
| 4 | acid pickling | 30 mass % nitric acid | normal temperature | 60 |
| 5 | secondary zincate treatment | MCT-51 | normal temperature | 30 |
| 6 | electroless Ni plating | NPR-18 | 80° C. | 180 |
| 7 | electroless Pd plating | TFP-23 | 56° C. | 500 |
| 8 | electroless Pt plating | Comp. No. 1-11<br>Examples No. 1-7 | 80° C. | 300 |

※Comp. stands for Comparative Example

TABLE 2

| Pt plating bath composition | | | Example 1 | Example 2 | Example 3 | Example 4 | Example 5 | Reference Example 1 | Reference Example 2 |
|---|---|---|---|---|---|---|---|---|---|
| stabilizing agent | sodium chloride | g/L | | | | | | | |
| reducing agent | sodium formate | g/L | 30 | 30 | 30 | 30 | 30 | | |
| | hydrazine monohydrate | g/L | | | | | | 1 | 1 |
| buffer agent | boric acid | g/L | 10 | 10 | 10 | 10 | 10 | 10 | 10 |
| | Trisodium Phosphate 12-Water | g/L | 10 | 10 | 10 | 10 | 10 | 10 | 10 |
| water soluble platinum compound | chloroplatinic (II) acid (as Pt) | g/L | | | | | | | |
| | dinitroammine platinum (II) nitrate (as Pt) | g/L | | | | | | | |
| | tetraammine platinum (II) dichloride (as Pt) | g/L | | | | | | | |
| | hexaammine platinum (TV) hydroxide (as Pt) | | | | | | | | |
| | tetraammine platinum (II) hydroxide (as Pt) | g/L | 0.6 | | 0.6 | 0.6 | 0.6 | 0.6 | |
| | tetraammine platinum (II) nitrate (as Pt) | g/L | | 0.6 | | | | | 0.6 |
| pH | | | 10 | 10 | 9 | 8 | 7 | 8 | 8 |
| plating bath temperature | | | 80 | 80 | 80 | 80 | 80 | 80 | 80 |
| Pt film thickness (μm) | | 200 μm | 0.20 | 0.24 | 0.20 | 0.15 | 0.10 | 0.01 | 0.02 |
| | | 100 μm | 0.24 | 0.25 | 0.23 | 0.14 | 0.12 | 0.02 | 0.02 |
| | | 60 μm | 0.26 | 0.26 | 0.24 | 0.14 | 0.12 | 0.02 | 0.02 |
| electroless plating bath stability | | | Good | Good | Good | Good | Good | Failure | Failure |
| Si Wafer substrate corrosion | | | Medium-Weak | Medium-Weak | Medium-Weak | Medium-Weak | Medium-Weak | Weak | Weak |

TABLE 3

| Pt plating bath composition | | | Comp. 1 | Comp. 2 | Comp. 3 | Comp. 4 | Comp. 5 | Comp. 6 |
|---|---|---|---|---|---|---|---|---|
| stabilizing agent | sodium chloride | g/L | 10 | 10 | | 10 | | |
| reducing agent | sodium formate | g/L | 30 | 30 | 30 | 30 | 30 | 30 |
| | hydrazine monohydrate | g/L | | | | | | |

TABLE 3-continued

| | | | | | | | | |
|---|---|---|---|---|---|---|---|---|
| buffer agent | boric acid | g/L | 10 | 10 | 10 | 10 | 10 | 10 |
| | Trisodium Phosphate 12-Water | g/L | 10 | 10 | 10 | 10 | 10 | 10 |
| water soluble platinum compound | chloroplatinic (II) acid (as Pt) | | 0.6 | | | | | |
| | dinitroammine platinum (II) nitrate (as Pt) | g/L | | 0.6 | 0.6 | | | |
| | tetraammine platinum (II) dichloride (as Pt) | g/L | | | | 0.6 | 0.6 | |
| | hexaammine platinum (IV) hydroxide (as Pt) | g/L | | | | | | 0.6 |
| | tetraammine platinum (II) hydroxide (as Pt) | g/L | | | | | | |
| | tetraammine platinum (II) nitrate (as Pt) | g/L | | | | | | |
| pH | | | 10 | 10 | 10 | 10 | 10 | 10 |
| plating bath temperature | | | 40 | 50 | 50 | 80 | 80 | 80 |
| Pt film thickness (μm) | | 200 μm | 0.01 | 0.01 | — | 0.21 | 0.22 | N/A |
| | | 100 μm | N/A | 0.01 | — | 0.23 | 0.24 | N/A |
| | | 60 μm | N/A | N/A | — | 0.24 | 0.26 | N/A |
| electroless plating bath stability | | | Failure | Poor | Failure | Good | Good | Good |
| Si Wafer substrate corrosion | | | Strong | Strong | Medium-Weak | Strong | Strong | Medium-Weak |

| Pt plating bath composition | | | Comp. 7 | Comp. 8 | Comp. 9 | Comp. 10 | Comp. 11 |
|---|---|---|---|---|---|---|---|
| stabilizing agent | sodium chloride | g/L | 10 | 10 | 10 | 3.0 | 10 |
| reducing agent | sodium formate | g/L | 30 | 30 | | | |
| | hydrazine monohydrate | g/L | | | 1 | 1 | 1 |
| buffer agent | boric acid | g/L | 10 | 10 | 10 | 10 | 10 |
| | Trisodium Phosphate 12-Water | g/L | 10 | 10 | 10 | 10 | 10 |
| water soluble platinum compound | chloroplatinic (II) acid (as Pt) | | | | | | |
| | dinitroammine platinum (II) nitrate (as Pt) | g/L | | | | | |
| | tetraammine platinum (II) dichloride (as Pt) | g/L | | | 0.6 | | |
| | hexaammine platinum (IV) hydroxide (as Pt) | g/L | | | | | |
| | tetraammine platinum (II) hydroxide (as Pt) | g/L | 0.6 | | | 0.6 | |
| | tetraammine platinum (II) nitrate (as Pt) | g/L | | 0.6 | | | 0.6 |
| pH | | | 10 | 10 | 8 | 8 | 8 |
| plating bath temperature | | | 80 | 80 | 80 | 80 | 80 |
| Pt film thickness (μm) | | 200 μm | 0.22 | 0.21 | 0.02 | 0.01 | 0.02 |
| | | 100 μm | 0.24 | 0.23 | 0.02 | 0.02 | 0.02 |
| | | 60 μm | 0.26 | 0.26 | 0.02 | 0.02 | 0.02 |
| electroless plating bath stability | | | Good | Good | Failure | Failure | Failure |
| Si Wafer substrate corrosion | | | Strong | Strong | Medium-Weak | Medium-Weak | Medium-Weak |

※Comp. stands for Comparative Example

※N/A stands for undeposition

Examples No. 1 to 5 in Table 2 showed the present inventive examples using the electroless Pt plating bath satisfying present inventive requirements. These present inventive examples showed excellent properties in plating film deposition allowing to deposit a Pt plating film on the micropads. In addition, corrosion of the substrate was suppressed adequately during plating treatment. Among examples, Examples No. 1 to 5 using formic acids as a reducing agent exhibited excellent properties in corrosion suppression to the substrate and electroless plating bath stability for over a week without containing halides in the electroless plating bath compared with the results of Reference Examples No. 1 and 2 using hydrazines. Compared with hydrazines, formic acids have tendency of lower reducing reaction. However, the present inventive electroless Pt plating bath attains excellent properties in plating film deposition by maintaining its electroless plating bath stability and its corrosion suppression of a substrate in higher formic acids concentration in the electroless Pt plating bath of the invention.

Comparative Examples No. 1 to 11 in Table 3 were the electroless Pt plating bath without satisfying a present inventive requirement. These comparative examples showed following defects.

Comparative Example No. 1 contained chloroplatinic (II) acid as a water soluble Pt compound and sodium chloride as a stabilizing agent. Comparative Example No. 1 could not form a Pt plating film on the micropads of 100 μm or less. And Comparative Example No. 1 showed corrosion of the substrate attributed to chloride contained in the electroless plating bath. Furthermore, Comparative Example No. 1 showed considerably low electroless plating bath stability due to the low concentration of chloride derived from chloroplatinic (II) acid in the electroless plating bath.

Comparative Example No, 2 contained dinitroammine Pt (II) nitrate and sodium chloride. Comparative Example No. 2 could not form a Pt plating film on the micropad of 60 μm or less. And Comparative Example No. 2 showed corrosion of the substrate attributed to chloride contained in the electroless plating bath and low electroless plating bath stability.

Comparative Example No. 3 had the same composition as Comparative Example No. 2 except sodium chloride. Comparative Example No. 3 suppressed corrosion of the substrate due to low chlorine concentration in the electroless plating bath. However, Comparative Example No. 3 had considerably low electroless plating bath stability and resulted in unable to use as a electroless plating bath.

Comparative Example No. 4 contained Tetraammine Pt (II) dichloride and sodium chloride. Comparative Example No. 4 showed corrosion of the substrate attributed to chloride contained in the electroless plating bath.

Comparative Example No. 5 had the same composition as Comparative Example No. 4 except sodium chloride. Comparative Example No. 5 showed favorable electroless plating bath stability due to chloride derived from tetraammine Pt (II) dichloride even though the plating bath lacked sodium chloride. However, Comparative Example No. 5 showed corrosion of the substrate.

Comparative Example No. 6 contained hexaammine Pt (IV) hydroxide. Comparative Example No. 6 could not form a Pt plating film on the micropads because of excessive stability of the complex.

Comparative Example No. 7 contained tetraammine Pt (II) hydroxide and sodium chloride. Comparative Example No. 7 showed corrosion of the substrate attributed to chloride contained in the electroless plating bath.

Comparative Example No. 8 contained sodium chloride and tetraammine Pt (II) nitrate. Comparative Example No. 8 showed corrosion of the substrate attributed to chloride contained in the electroless plating bath.

Comparative Example No. 9 contained tetraammine Pt (II) dichloride and sodium chloride. Comparative Example No. 9 containing hydrazine showed low electroless plating bath stability.

Comparative Example No. 10 contained sodium chloride and tetraammine Pt (II) hydroxide. Comparative Example No. 10 containing hydrazine showed low electroless plating bath stability.

Comparative Example No. 11 contained sodium chloride and tetraammine Pt (II) nitrate. Comparative Example No. 11 containing hydrazine showed low electroless plating bath stability.

Comparing Comparative Examples No. 9 to 11 with Comparative Examples No. 4, 7, 8 having same composition except for a type of reducing agent and pH of the electroless plating bath, examples using hydrazine required to increase chloride concentration in the electroless plating bath for secure the electroless plating bath stability. And electroless plating, bath containing hydrazine within low amount showed low corrosiveness to the substrate.

Experiment 2: Electroless Pd Plating Bath

A laminate of metal conductive layers was deposited on one surface of a substrate by an electroless plating treatment. Plating pretreatment to the substrate shown in Table 4 were conducted before depositing an electroless plating film. That is, the plating pretreatment shown in following steps 1 to 5 were applied to the substrate in sequence. Note that detail conditions of the steps 1 to 5 in Experiment 2 were the same as those for Experiment 1.

After conducting pretreatment to the substrate, a Ni plating film as a conductive underlying layer was deposited on the surface of the substrate in step 6 under the condition shown in Table 4. Note that details of step 6 are the same as those described in Experiment 1.

In step 7, a Pd plating film was deposited by electroless plating treatment with a Pd plating bath shown in Tables 5 and 6 after depositing the underlying layer on the substrate. Same tests as Experiment 1 were conducted to the obtained test piece. Note that criteria for electroless plating bath stability and for substrate corrosion were changed as below but other criteria of the tests were the same as the criteria of Experiment 1.

[Electroless Plating Bath Stability]

Deposition of Pd particles was examined by visually observing the electroless Pd plating bath after electroless plating treatment and evaluated it based on the following criteria.

Good: no deposition of Pd particles was observed for more than 24 hours after the electroless plating treatment.

Poor: deposition of Pd particles was confirmed within 24 hours after the electroless plating treatment,

[Substrate Corrosion]

Corrosion of the substrate was evaluated by the following criteria by observing a non-deposition surface of the substrate, which was the other surface of the substrate having the plating film, with a Digital Microscope (VHX-5000 manufactured by KEYENCE CORPORATION).

The present invention evaluates "Weak" as good condition.

TABLE 4

| | plating pretreatment | process liquid | processing temperature | processing time (sec.) |
|---|---|---|---|---|
| 1 | degreasing | MCL-16 | 50° C. | 300 |
| 2 | acid pickling | 30 mass % nitric acid | normal temperature | 60 |
| 3 | primary zincate treatment | MCT-51 | normal temperature | 30 |
| 4 | acid pickling | 30 mass % nitric acid | normal temperature | 60 |
| 5 | secondary zincate treatment | MCT-51 | normal temperature | 30 |
| 6 | electroless Ni plating | NPR-18 | 80° C. | 180 |
| 7 | electroless Pd plating | Comparative Examples. No. 1-5<br>Examples No. 1-6 | | 300 |

TABLE 5

| Pd plating bath composition | | | Example 1 | Example 2 | Example 3 | Example 4 | Example 5 | Example 6 |
|---|---|---|---|---|---|---|---|---|
| stabilizing agent | sodium chloride | g/L | | | | | | |
| reducing agent | sodium formate | g/L | 30 | 30 | 30 | 30 | 30 | 30 |
| complexing agent | ethylenediamine sulfate | g/L | 6 | 6 | 6 | 6 | 6 | 6 |
| buffer agent | trisodium citrate dihydrate | g/L | 30 | 30 | 30 | 30 | 30 | 30 |
| water soluble | palladium (II) chloride (as Pd) | g/L | | | | | | |
| palladium compound | palladium (II) sulfate (as Pd) | g/L | | | | | | |

TABLE 5-continued

| Pd plating bath composition | | | Example 1 | Example 2 | Example 3 | Example 4 | Example 5 | Example 6 |
|---|---|---|---|---|---|---|---|---|
| | tetraammine palladium (II) dichloride (as Pd) | g/L | | | | | | |
| | tetraammine palladium (II) sulfate (as Pd) | | 0.6 | 0.6 | 0.6 | 0.6 | | |
| | tetraammine palladium (II) hydroxide (as Pd) | g/L | | | | | 0.6 | |
| | tetraammine palladium (II) nitrate (as Pd) | g/L | | | | | | 0.6 |
| pH | | | 5 | 6 | 7 | 8 | 5 | 5 |
| plating bath temperature | | | 60 | 60 | 60 | 60 | 60 | 60 |
| Pd film thickness (μm) | | 200 μm | 0.14 | 0.13 | 0.14 | 0.13 | 0.14 | 0.13 |
| | | 100 μm | 0.16 | 0.14 | 0.15 | 0.16 | 0.14 | 0.16 |
| | | 60 μm | 0.17 | 0.16 | 0.16 | 0.16 | 0.15 | 0.17 |
| electroless plating bath stability | | | Good | Good | Good | Good | Good | Good |
| Si Wafer substrate corrosion | | | Weak | Weak | Weak | Weak | Weak | Weak |

TABLE 6

| Pd plating bath composition | | | Comp. 1 | Comp. 2 | Comp. 3 | Comp. 4 | Comp. 5 |
|---|---|---|---|---|---|---|---|
| stabilizing agent | sodium chloride | g/L | 10 | | 10 | 10 | 10 |
| reducing agent | sodium formate | g/L | 30 | 30 | 30 | 30 | 30 |
| complexing agent | ethylenediamine sulfate | g/L | 6 | 6 | 6 | 6 | 6 |
| buffer agent | trisodium citrate dihydrate | g/L | 30 | 30 | 30 | 30 | 30 |
| water soluble | palladium (II) chloride (as Pd) | g/L | 0.6 | 0.6 | | | |
| palladium compound | palladium (II) sulfate (as Pd) | g/L | | | 0.6 | | |
| | tetraammine palladium (II) dichloride (as Pd) | g/L | | | | 0.6 | |
| | tetraammine palladium (II) sulfate (as Pd) | g/L | | | | | 0.6 |
| | tetraammine palladium (II) hydroxide (as Pd) | g/L | | | | | |
| | tetraammine palladium (II) nitrate (as Pd) | g/L | | | | | |
| pH | | | 5 | 5 | 5 | 5 | 5 |
| plating bath temperature | | | 60 | 60 | 60 | 60 | 60 |
| Pd film thickness (μm) | | 200 μm | 0.16 | 0.17 | N/A | 0.14 | 0.12 |
| | | 100 μm | 0.15 | 0.16 | N/A | 0.14 | 0.13 |
| | | 60 μm | 0.14 | 0.14 | N/A | 0.15 | 0.14 |
| electroless plating bath stability | | | Good | Failure | Good | Good | Good |
| Si Wafer substrate corrosion | | | Medium-Weak | Medium-Weak | Medium-Weak | Medium-Weak | Medium-Weak |

※Comp. stands for Comparative Example
※N/A stands for undeposition

Examples No. 1 to 6 in Table 5 showed the present inventive examples using the electroless Pd plating bath satisfying present inventive requirements. These present inventive examples showed excellent electroless plating bath stability for over 24 hours without containing halides in the electroless plating bath. And these present inventive examples showed excellent plating film deposition allowing to deposit the Pd plating film on the micropads. In addition, no corrosion of the substrate was found during plating treatment.

Comparative Examples No. 1 to 5 in Table 6 were the examples using electroless Pd bath without satisfying a present inventive requirement. These Comparative Examples showed following defects.

Comparative Example No. 1 contained Pd (II) chloride as a water soluble Pd compound and sodium chloride as a stabilizing agent. Comparative Example No. 1 showed corrosion of the substrate attributed to chloride contained in the electroless plating bath.

Comparative Example No. 2 contained Pd (II) chloride. Comparative Example No. 2 showed corrosion of the substrate attributed to chloride contained in the electroless plating bath and low electroless plating bath stability due to the low concentration of chloride in the electroless plating bath.

Comparative Example No. 3 contained Pd (II) sulfate and sodium chloride. Comparative Example No. 3 could not form a Pd plating film on the micropads. And Comparative Example No. 3 showed corrosion of the substrate attributed to chloride contained in the electroless plating bath.

Comparative Example No. 4 contained tetraammine Pd(II) dichloride and sodium chloride. Comparative Example No. 4 showed corrosion of the substrate attributed to chloride contained in the electroless plating bath.

Comparative Example No. 5 contained tetraammine Pd (II) sulfate and sodium chloride. Comparative Example No. 5 showed corrosion of the substrate attributed to chloride contained in the electroless plating bath.

The invention claimed is:

1. A halogen-free electroless plating bath comprising
a water soluble platinum compound or
a water soluble palladium compound, and
a reducing agent wherein the water soluble platinum compound is a tetraammine platinum (II) complex salt excluding a halide of the tetraammine platinum (II) complex salt, the water soluble palladium compound is tetraammine palladium (II) hydroxide or tetraammine palladium (II) nitrate and excludes a halide of a tetraammine palladium (II) complex salt and tetraammine palladium (II) sulfate, the reducing agent is formic acid or its salts, and the electroless plating bath contains no halide as an additive.

2. The halogen-free electroless plating bath according to claim 1, wherein the tetraammine platinum (II) complex salt is tetraammine platinum (II) hydroxide or tetraammine platinum (II) nitrate.

* * * * *